US010119541B2

(12) United States Patent
Blank et al.

(10) Patent No.: US 10,119,541 B2
(45) Date of Patent: Nov. 6, 2018

(54) PUMP DEVICE WITH A VACUUM PUMP AND A LUBRICATION PUMP

(71) Applicant: Joma-Polytec GmbH, Bodelshausen (DE)

(72) Inventors: Andreas Blank, Hechingen (DE); Torsten Helle, Tuebingen (DE); Martin Thoma, Riederich (DE)

(73) Assignee: Joma-Polytec GmbH, Bodelshausen (DE)

( * ) Notice: Subject to any disclaimer, the term of this patent is extended or adjusted under 35 U.S.C. 154(b) by 294 days.

(21) Appl. No.: 14/532,268

(22) Filed: Nov. 4, 2014

(65) Prior Publication Data

US 2015/0132155 A1 May 14, 2015

(30) Foreign Application Priority Data

Nov. 7, 2013 (DE) ..... 10 2013 222 591

(51) Int. Cl.
*F04C 28/06* (2006.01)
*F04C 18/344* (2006.01)
(Continued)

(52) U.S. Cl.
CPC ..... *F04C 23/005* (2013.01); *F04C 2/344* (2013.01); *F04C 11/005* (2013.01);
(Continued)

(58) Field of Classification Search
CPC ..... F04C 29/028; F04C 29/023
(Continued)

(56) References Cited

U.S. PATENT DOCUMENTS 2,696,790 A * 12/1954 Crow ..... F01C 21/0827 418/146
2,737,341 A 3/1956 Bitzer
(Continued)

FOREIGN PATENT DOCUMENTS

CN 202250533 U 5/2012
CN 102840134 A 12/2012
(Continued)

OTHER PUBLICATIONS

Sep. 29, 2014 German Examination Report for German Application No. 10 2013 222 591.1.
(Continued)

*Primary Examiner* — Peter J Bertheaud
*Assistant Examiner* — Geoffrey S Lee
(74) *Attorney, Agent, or Firm* — Howard & Howard Attorneys PLLC

(57) ABSTRACT

A pump device having a drive shaft which has a drive section that can be coupled with a drive system. The pump device includes a vacuum pump that can be driven by the drive shaft. The vacuum pump includes a rotor and at least one blade that can be moved in radial direction in the rotor and that divides pressure chambers. The pump device also includes a lubrication pump that can be driven by the drive shaft. The vacuum pump is arranged between the drive section and the lubrication pump. A locking device is provided between the rotor and the lubrication pump in which, when activated, the at least one blade remains in a radially internal position when the rotor is rotating.

8 Claims, 4 Drawing Sheets

(51) Int. Cl.
*F04C 2/344* (2006.01)
*F04C 23/00* (2006.01)
*F04C 11/00* (2006.01)

(52) U.S. Cl.
CPC ..... *F04C 18/344* (2013.01); *F04C 28/06* (2013.01); *F04C 2210/206* (2013.01); *F04C 2220/10* (2013.01)

(58) Field of Classification Search
USPC ..... 418/23, 255, 259, 266–268; 417/214
See application file for complete search history.

(56) References Cited

U.S. PATENT DOCUMENTS 3,199,771 A * 8/1965 Becker ..... F04C 18/3442 418/15
3,649,140 A * 3/1972 Harlin ..... F04C 29/025 418/87
3,877,853 A * 4/1975 Harlin ..... F01C 21/0872 184/6.16
4,050,263 A * 9/1977 Adalbert ..... B60H 1/3208 417/205
4,132,512 A * 1/1979 Roberts ..... F04C 28/06 418/158
4,472,119 A * 9/1984 Roberts ..... F01C 21/0809 418/23
4,505,653 A * 3/1985 Roberts ..... F01C 21/0863 418/23
4,516,919 A * 5/1985 Roberts ..... F01C 20/06 418/23
4,586,468 A 5/1986 Dzioba
6,190,149 B1 2/2001 Richman
7,229,250 B2 * 6/2007 McCallum ..... F04D 27/002 123/41.49
7,726,453 B2 * 6/2010 Cadeddu ..... F04C 2/344 192/58.91

FOREIGN PATENT DOCUMENTS

CN 102889207 A 1/2013
CN 202718862 U 2/2013
DE 25 02 184 A1 7/1976
DE 85 17 622 U1 11/1986
DE 10 2012 002 672 A1 5/2013

OTHER PUBLICATIONS

Notification of the First Office Action for Chinese Patent Application No. 201410643807.7 dated Feb. 14, 2018.

* cited by examiner

PUMP DEVICE WITH A VACUUM PUMP AND A LUBRICATION PUMP

CROSS-REFERENCE TO RELATED APPLICATION

This application is based upon and claims priority to German Patent Application No. DE 102013222591.1, filed on Nov. 7, 2013.

BACKGROUND OF THE INVENTION

1. Field of the Invention

The present invention relates, generally, to pumping devices and, more specifically, to a pump device having a drive shaft which has a drive section that can be coupled with a drive system. The pump device also has a vacuum pump that can be driven by the drive shaft. The vacuum pump includes a rotor and at least one blade that can be moved in radial direction in the rotor. The blade divides a pump space of the pump into pressure chambers. The pump device also includes a lubrication pump that can be driven by the drive shaft.

2. Description of the Related Art

Pump devices are well known in the related art, especially in the automotive field. Typically, the pump device includes a drive shaft driven by a combustion engine. On the one hand, the drive shaft drives a vacuum pump that provides a source of vacuum, used such as with a brake booster. The drive shaft may also drive a lubrication pump that displaces lubrication, used such as in the engine oiling system and/or for lubricating other components. The vacuum pump and the lubrication pump may advantageously be arranged along an axis. Various vacuum pumps are known from German publications DE 250184 A1 and DE 8517622.

While pump devices known in the related art have generally performed well for their intended purpose, there remains a need in the art for a pump device that can be configured such that the vacuum pump can be turned off, even during the operation of the vehicle, and particularly when no vacuum has to be provided for the brake booster. In this way, it is possible to save energy. Moreover, it is desirable that the pump device has an overall compact design where the vacuum pump and the lubrication pump are driven by the drive shaft.

SUMMARY OF THE INVENTION

The present invention overcomes the disadvantages in the related art of a pump device having a drive shaft with a drive section that can be coupled with a drive system. The pump device includes a vacuum pump that can be driven by the drive shaft. The vacuum pump includes a rotor and at least one blade that can be moved in radial direction in the rotor. The blade defines pressure chambers. The pump device also includes a lubrication pump that can be driven by the drive shaft. The vacuum pump is arranged between the drive section and the lubrication pump. A locking device is provided in which, when activated, the at least one blade remains in a radially internal position when the rotor is rotating.

In this way, it is possible to provide an optimum arrangement in a small installation space. Specifically, the locking device of the pump device makes it possible to deactivate the vacuum pump during the rotation of the rotor, whereby the at least one blade remains in the radially internal position when the rotor is rotating.

The vacuum pump or its rotating rotor drives the lubrication pump, or the rotor is rotationally coupled with the shaft of the lubrication pump. The locking device is provided between the rotor and the lubrication pump or between the rotor and the drive section. In one embodiment, the rotor includes two blades arranged in parallel next to each other which, in particular, can be spaced apart.

Advantageously, the drive shaft is rotationally coupled with the rotor and the lubrication pump has a pump shaft which is also rotationally coupled with the rotor. As a result, a torque is applied via the drive section on the drive shaft. Thus, the torque is applied by the drive shaft in the rotor and is transmitted via the rotor on the pump shaft. This results in a relatively compact construction.

Between the rotor and the pump shaft, a rotary member rotationally coupled with the rotor and the pump shaft may be provided. The rotary member forms a counter bearing of the rotor and the pump shaft. Advantageously, the rotary member is pivoted in a housing section which can be flange-mounted at a housing of the vacuum pump or can be part of the housing.

The rotary member may have lubricating ducts, wherein the rotor, the blade, and/or the rotating member are lubricated via the lubricating ducts. Likewise, the rotating member can also have or restrict a pressure port provided for actuating an activation valve to activate the locking device.

The activation valve may have two switching positions and may include a lubrication inlet, a first lubrication outlet into the rotor, and a second lubrication outlet into the pressure chamber. As a result, the radially internal region of the rotor can be supplied via the first lubrication outlet with lubricant (such as lubricating oil) or with a specific oil pressure. This ensures that radially internal regions of the at least one blade are appropriately lubricated and/or are supplied with oil pressure. The second lubrication outlet may open into regions of the pressure chambers, whereby it can be ensured that the radially external ends of the at least one blade are appropriately lubricated and are effectively sealed. Advantageously, the activation valve may be designed in the form of a three or two-way valve.

In one embodiment, the activation valve is designed such that the lubrication inlet is connected to the first lubrication outlet and the second lubrication outlet when the activation valve is not actuated. Furthermore, it is advantageous where the lubrication inlet is not connected to the first lubrication outlet, and is only connected to the second lubrication outlet when the activation valve is actuated. By detaching the connection between the lubrication inlet and the second lubrication outlet, the radially internal region of the at least one blade is no longer supplied with oil pressure. Thus, the blades can assume their radially internal position.

The activation valve can have a pressure chamber connected to the pressure port. The pressure chamber is restricted by a ram that can be shifted axially, wherein the ram has a control edge which detaches the connection between the lubrication inlet and the lubrication outlet when the valve is actuated. In this way, the valve is pressure controlled when pressure is applied to the pressure chamber.

In operation, the ram can directly or indirectly actuate a blocking element, which acts on the at least one blade when the locking device is activated, retaining the blade in its internal position. As a result, the ram is used not only for activating the locking valve, but also for mechanically activating the blocking element. To that end, the ram can have a control element on a side facing away from the pressure chamber for activating the blocking element. For example, the control element can be designed in the form of a piston-rod-like adjustment bolt which acts with a free end upon the blocking element.

To retain the ram in a defined position, it is advantageous that the ram is supplied with a compression spring on a side facing away from the pressure chamber. In the event that a control element is provided, the control element can engage the spring, which may be designed in the form of a helical spring. Moreover, the blocking element can be designed in such a way that it acts axially or radially upon the at least one blade.

In one embodiment, a center of gravity of the at least one blade is designed in such a way that the blade assumes a radially internal position when the activation valve is actuated and when the first lubrication outlet is detached from the lubrication inlet. Because the first lubrication outlet is detached, the oil pressure in the radially internal region of the rotor is eliminated. As a result, the blades can assume a radially internal position. By respectively selecting the center of gravity of the blades, the blades maintain their radially internal position even when the rotor is rotating.

BRIEF DESCRIPTION OF THE DRAWINGS

Other objects, includes, and advantages of the present invention will be readily appreciated as the same becomes better understood after reading the subsequent description taken in connection with the accompanying drawing wherein.

DETAILED DESCRIPTION OF THE INVENTION

Figure 1:
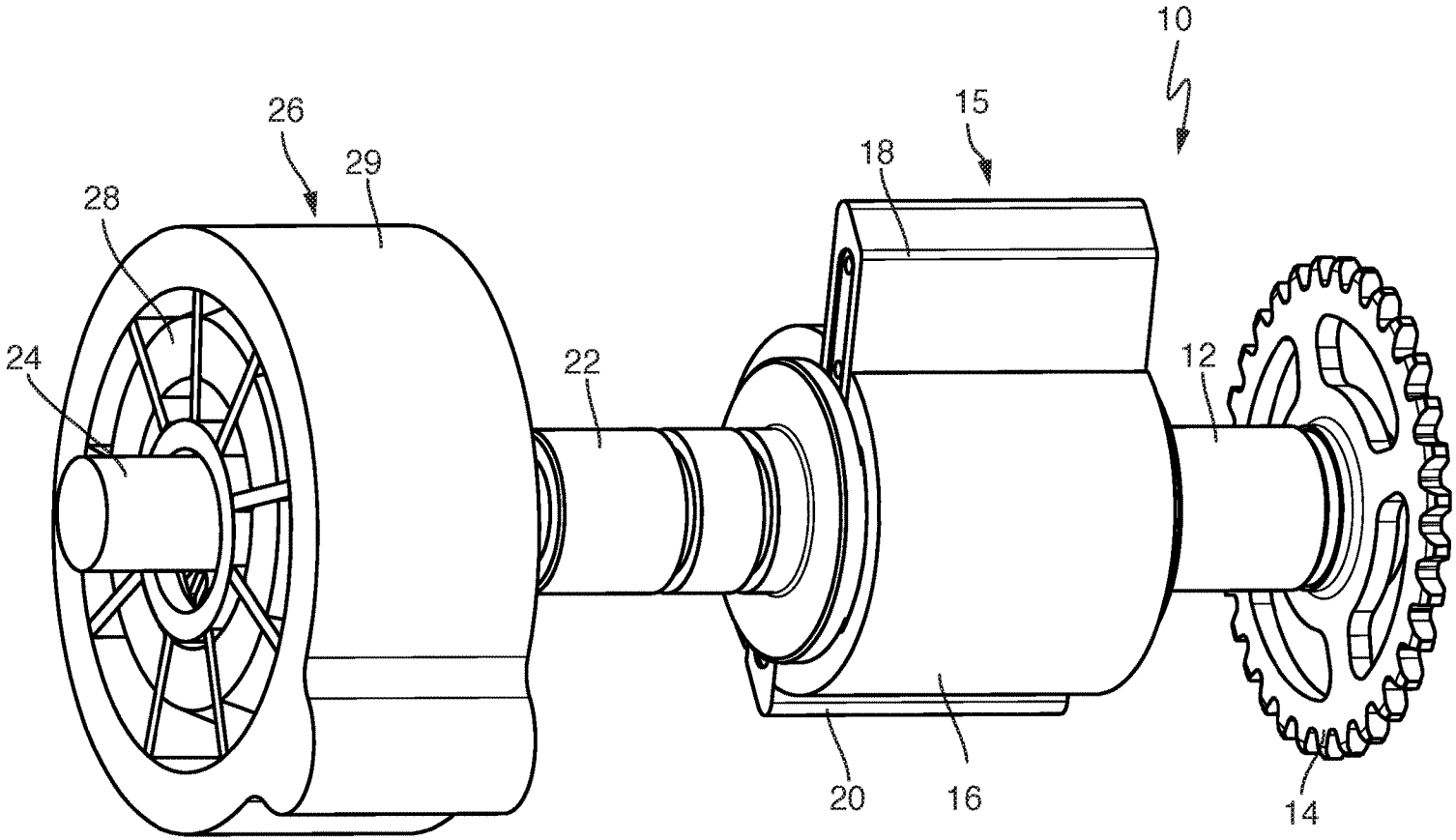
FIG. 1 is a partial perspective view of a pump device according to one embodiment of the present invention.

Referring now to the drawings, FIG. 1 shows a pump device 10 with a drive shaft 12 which has a drive section 14 in the form of a gear wheel. The drive section 14 can be actuated such as by of a drive chain driven by an automobile engine.

The drive shaft is rotationally coupled with a rotor 16 of a vacuum pump 15. The vacuum pump 15 has a housing (not shown in FIG. 1). In the rotor 16, two blades 18, 20 are mounted which can be moved in radial direction. In operation, the blades 18, 20 divide a pump space into pressure chambers. As a result, vacuum can be generated when rotating the rotor 16, used such as for operating a brake booster.

On a side of the rotor 16 facing away from the drive section 14, the rotor 16 is rotationally coupled, via a rotary member 22, with a pump shaft 24 of a lubrication pump 26. As shown in FIG. 1, a pump rotor 28 is arranged on the pump shaft 24 and has an adjustable cage 29 for a variable oil pump.

When rotating the drive section 14, the rotor 16 and the pump rotor 28 are set in rotation. At the same time, the vacuum pump 15 is spatially arranged between the drive section 14 and the lubrication pump 26.

Figure 2:
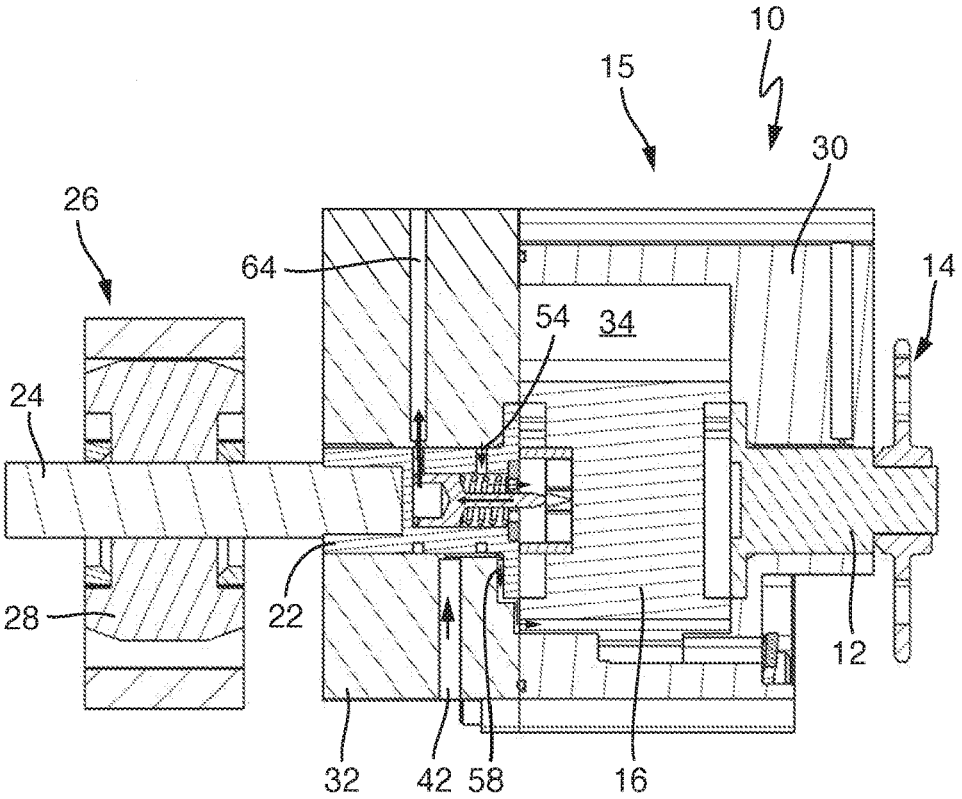
FIG. 2 is a longitudinal sectional view of the device of FIG. 1, showing a housing of a vacuum pump and a deactivated locking device.

The longitudinal section illustrated in FIG. 2 shows a pot-shaped pump housing which receives the rotor 16. On a side facing away from the drive section 14, the pump housing is covered with a cover plate 32. The rotary member 22 is pivoted in the plate 32 and is rotationally coupled with the rotor 16. The housing 30 and the cover plate 32 surround the pump space 34 of the vacuum pump 15, which is divided by the blades 18, 20 in pressure chambers.

As shown in FIG. 2, the rotor is mounted via the drive shaft 12 in the pump housing 30. A counter bearing is formed by the rotary member 22, which is pivoted in the cover plate 32. In addition, the pump shaft 24 is mounted via the rotary member 22 in the cover plate 32.

Between the rotor 16 and the rotary member 22, a locking device 36 is provided. The locking device 36 is used to retain the blades 18, 20 in their radially internal position. The locking device 36 can be actuated via an activation valve 38.

Figure 3:
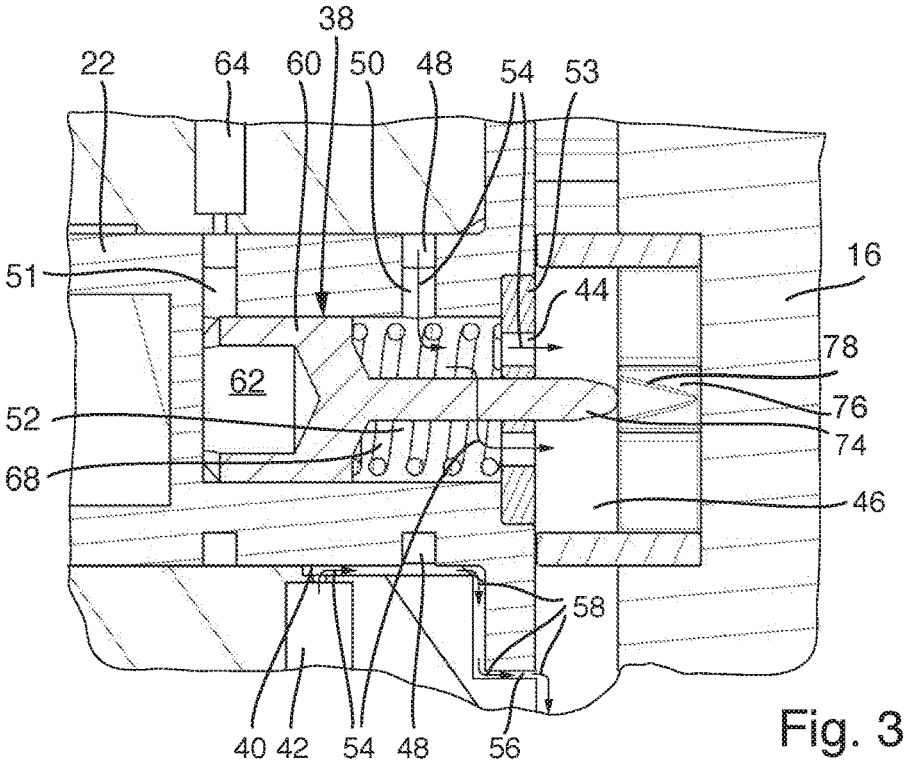
FIG. 3 is an enlarged view of FIG. 2.

The activation valve 38 is shown in an enlarged section in FIG. 3. The rotary member 22 restricts a lubrication inlet 40, which is connected to a lubricating duct 42 provided in the cover plate 32. Furthermore, a first lubrication outlet 44 is provided through which lubricant can flow from the lubrication inlet 40 into the radially internal region 46 of the rotor 16. To that end, a circumferential oil groove 48 is provided in the radially external region of the rotary member 22, and drill hole 50 provided within the rotary member 22 and extends radially in one direction and opens into a cylinder space 52. On a side facing the rotor 16, the cylinder space 52 has a plate 53 which is pressed into the rotary member 22 and in which a first lubrication outlet 44 in the form of cut-outs is provided. The cut-outs lead into the radially internal region 46 of the rotor 16. The lubricating oil flowing from the lubricating duct 42 into the radially internal region 46 is indicated at 54.

The pressurized lubricating oil available in the lubricating duct 42 pushes the blades 18, 20 under low oil pressure radially to the outside.

In one embodiment, the lubrication inlet 40 is fluid-connected to a leakage gap 56 so as to ensure that lubricant can enter the pump chamber 34 for lubricating the blades 18, 20 and thereby seal the pressure chambers. The lubricating oil flowing through this gap 56 is indicated at 58.

Figure 4:
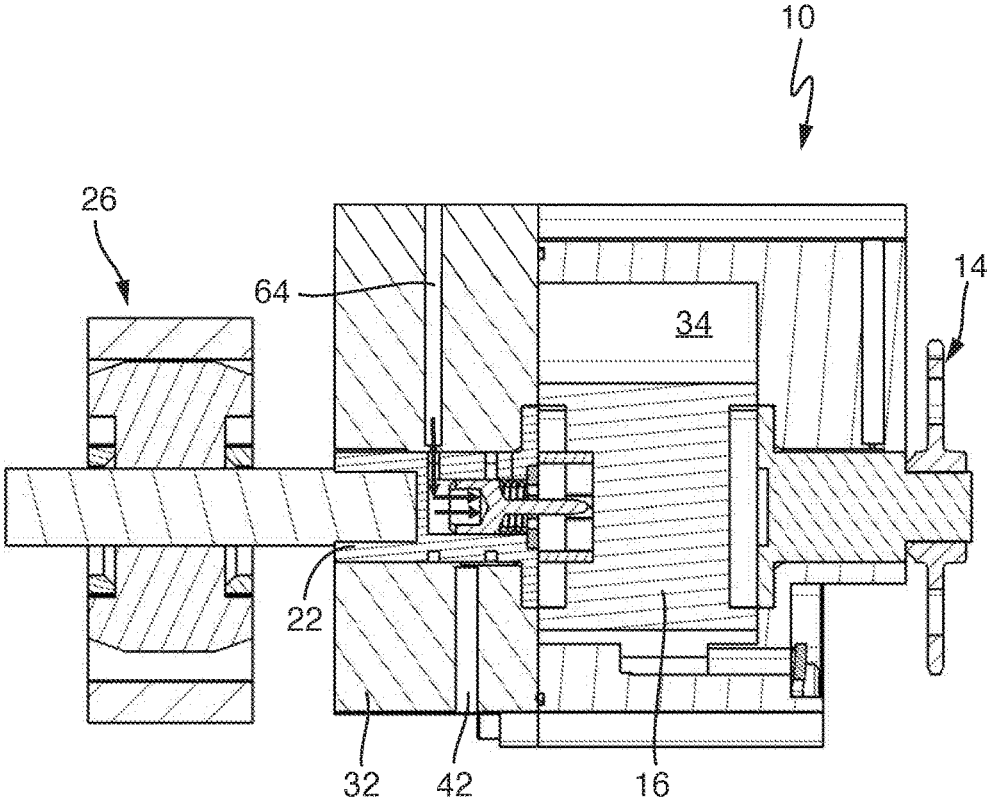
FIG. 4 is an alternate view of FIG. 2 showing an activated locking device.
Figure 5:
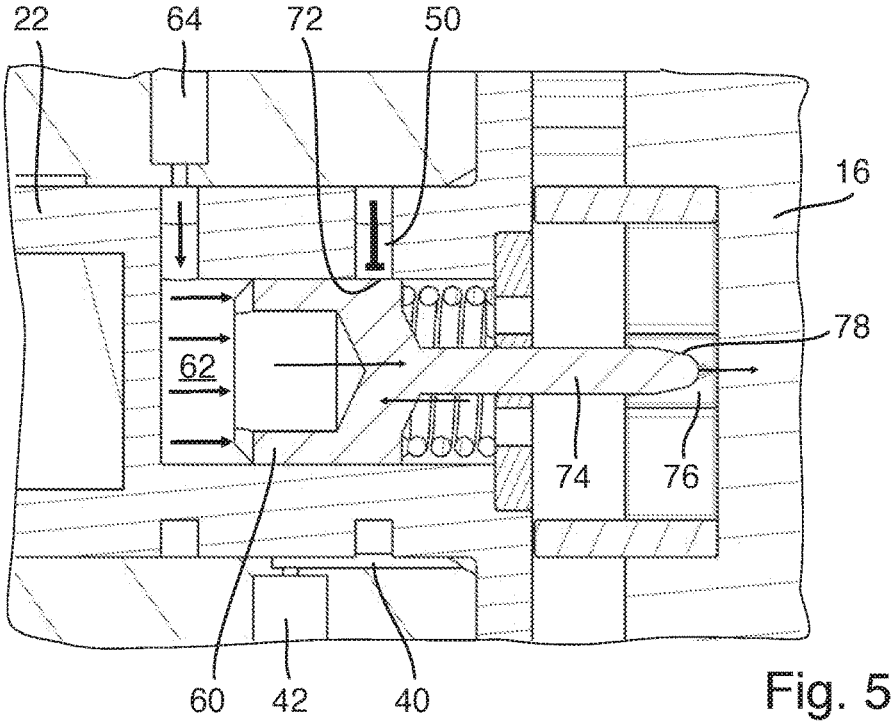
FIG. 5 is an enlarged view of FIG. 4.

As shown in FIGS. 4 and 5, the pressure line 64 is pressurized. As a result, the activation valve 38 is actuated and the ram 60 is pushed against the force of the spring 68 into the position shown in FIGS. 4 and 5. The ram 60 has a control edge 72 which closes the drill hole 50, whereby lubricating oil is supplied, when the pressure chamber 62 is pressurized. Here, because no lubricating oil 54 flows into the radially internal region 46 of the rotor 16, the blades 18, 20 can assume a radially internal position.

When shifting the ram 60, the locking device is actuated. A control element 74 provided on a side of the ram and facing the rotor 16 is engaged in a region of the rotor 16 which is located between the two blades 18, 20. As a result, a blocking element 76 (see also FIG. 7) arranged in the rotor between the two blades 18 and 20 is expanding in radial direction. Because of this expansion, the blades 18, 20 are mechanically retained in their radially internal position. As a result, the blocking element 76 acts in radial direction against the blades 18, 20.

Figure 6:
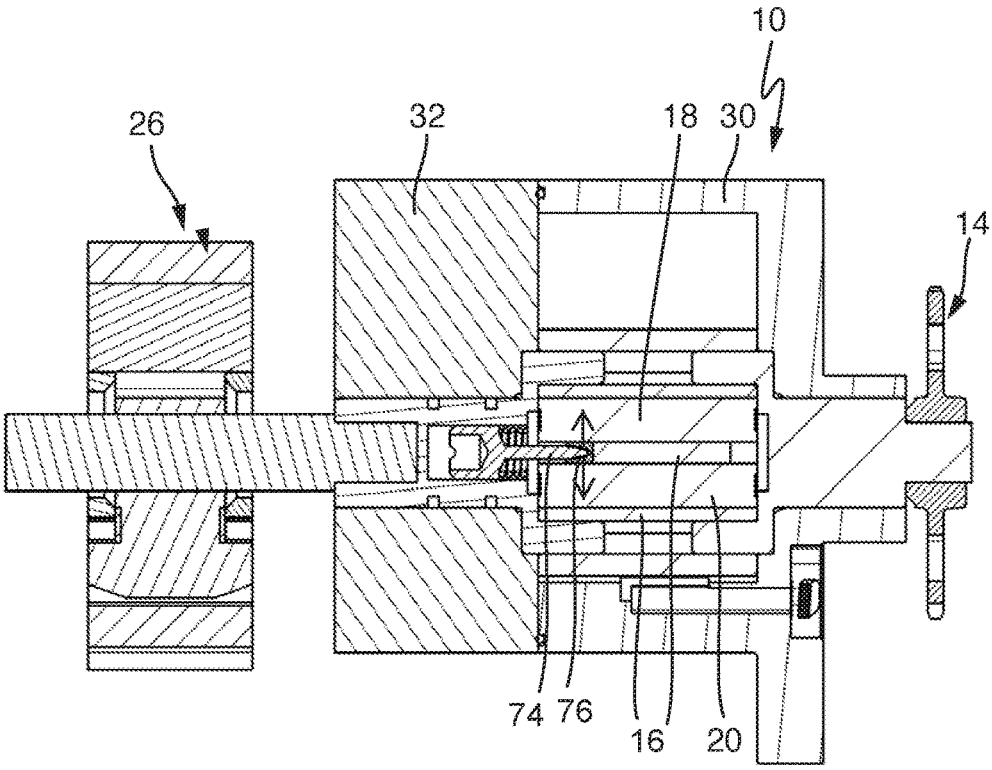
FIG. 6 is an alternate sectional view of FIG. 4.

FIG. 6 shows an intersection perpendicular to the plane of the blades 18 and 20, showing the blades arranged in parallel next to each other.

Figure 7:
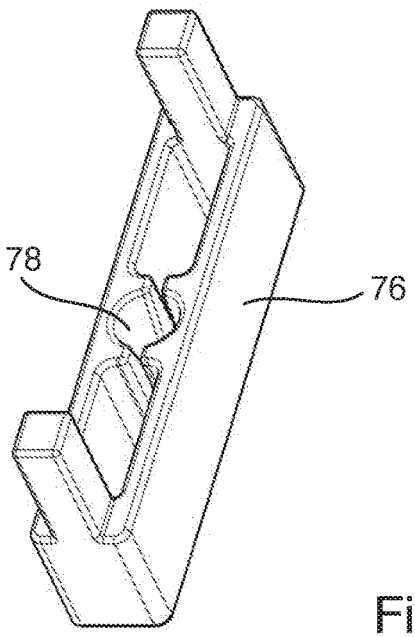
FIG. 7 is an enlarged perspective view of a blocking element of the pump device of FIG. 6.

The blocking element 76 shown in FIG. 7 has in a central portion a clamping cone 78 in which a free end of the control element 74, which also has a conical design, can be received when the locking device 36 is actuated, ultimately expanding the central portion of the blocking element 76 radially to the outside against the blades 18, 20.

When the pressure chamber 62 is supplied with appropriate pressure, the activation valve 38 is activated, whereby an oil supply into the radially internal region 46 of the rotor is stopped and the locking device 36 is actuated in order to retain the blades 18, 20 in the radially internal position. It is conceivable that an oil discharge from the radially internal region 46 of the rotor, via a discharge channel, may be opened when the ram is shifted.

It is conceivable that the locking device may retain the blades in the radially internal position by selecting appropriately the center of gravity of the blades. When interrupting the oil supply into the radially internal region 46, the oil pressure pushing the blades radially to the outside is eliminated. Because of the appropriate center of gravity of the blades, the blades remain in the radially internal position without requiring mechanical restraint, such as the blocking element 76. Moreover, the locking device could supply the blades in axial direction with a friction shoe and could retain them in their radially internal position.

In this way, the pump device 10 of the present invention is advantageous in that the vacuum pump 15 is arranged between the drive section 14 and the high pressure oil pump 26, wherein despite rotating rotor 16, the vacuum pump 15 can be reliably deactivated or their blades 18, 20 can be shifted into the radially internal position. Thus, the lubrication pump 26 is driven via the rotor 16 and the vacuum pump 15 runs without consuming energy until the activation valve 38 is appropriately controlled and the locking device 36 is deactivated.

What is claimed is:

1. An automotive pump device comprising:

a drive shaft which includes a drive section that can be coupled with a drive system of a combustion engine;

a lubrication pump used in the engine oiling system and for lubricating other components that are driven by the drive shaft;

a vacuum pump of a brake booster that is driven by the drive shaft, wherein the vacuum pump includes a rotor having an inner and an outer portion and two blades, said blades being movable in radial directions while being guided by the rotor whereby the blades divide pressure chambers, and whereby the blades are arranged in parallel to each other, said vacuum pump is arranged in the axial direction between the drive section and the lubrication pump, said drive shaft is rotationally coupled with the rotor and the lubrication pump includes a pump shaft that is rotationally coupled with the rotor, a rotary member is disposed in axial direction between the rotor and the pump shaft, said rotary member rotationally coupled at one axial end with the rotor and rotationally coupled at its other axial end with the pump shaft;

a control element and a blocking element, said rotary member includes an activation valve to activate the blocking element;

said activation valve comprises a pressure chamber extending inside the rotary member extending in an axial direction, which is restricted by a ram comprising the control element at its free end on a side facing away from the pressure chamber, wherein said ram acts to restrict the pressure chamber and is shiftable in the axial direction when pressure is supplied to the pressure chamber, and said blocking element disposed in the rotor between the two parallel blades and is a unitary piece with a clamping cone disposed in an expandable central portion thereof in which the control element can be received, and when activated, the control element moves in the axial direction against the clamping cone and expands the central portion of the blocking element radially against the blades to retain the blades by friction in the radially internal position.

2. The automotive pump device as set forth in claim 1, wherein the rotary member forms a counter bearing of the rotor and the pump shaft.

3. The automotive pump device as set forth in claim 1, wherein the rotary member has or restricts lubricating ducts for lubricating the rotor, the blade and/or the rotary member.

4. The automotive pump device as set forth in claim 1, wherein the rotary member provides or restricts a pressure port for actuating said activation valve.

5. The automotive pump device as set forth in claim 4, wherein the activation valve has two switching positions, a lubrication inlet, a first lubrication outlet into the rotor, and a second lubrication outlet into the pressure chambers.

6. The automotive pump device as set forth in claim 5, wherein the activation valve is configured such that the lubrication inlet is connected to the first lubrication outlet and the second lubrication outlet when the activation valve is not actuated, and/or configured such that the lubrication inlet is connected to the second lubrication outlet and is not connected to the first lubrication outlet when the activation valve is actuated.

7. The automotive pump device as set forth in claim 5, wherein the activation valve has a pressure chamber which is restricted by the ram that can be shifted in an axial direction, wherein the ram has a control edge which detaches the connection between the first lubrication inlet and the lubrication outlet when the valve is actuated.

8. The automotive pump device as set forth in claim 7, wherein the ram is supplied with a compression spring on a side of the ram facing away from the pressure chamber.

* * * * *